US007258290B2

(12) United States Patent
Taketomi et al.

(10) Patent No.: US 7,258,290 B2
(45) Date of Patent: Aug. 21, 2007

(54) JET MILL

(75) Inventors: Kenji Taketomi, Tokyo (JP); Kazumi Kozawa, Saitama (JP); Satoshi Akiyama, Saitama (JP)

(73) Assignee: Nisshin Engineering Inc., Tokyo (JP)

( * ) Notice: Subject to any disclaimer, the term of this patent is extended or adjusted under 35 U.S.C. 154(b) by 314 days.

(21) Appl. No.: 10/931,973

(22) Filed: Sep. 2, 2004

(65) Prior Publication Data

US 2005/0051649 A1 Mar. 10, 2005

(30) Foreign Application Priority Data

Sep. 5, 2003 (JP) ..... 2003-313624
Oct. 10, 2003 (JP) ..... 2003-352312

(51) Int. Cl.
*B02C 11/08* (2006.01)

(52) U.S. Cl. ..... 241/40; 241/79.1

(58) Field of Classification Search ..... 241/5, 241/39, 40, 79.1

See application file for complete search history.

(56) References Cited

U.S. PATENT DOCUMENTS

| | | | | |
|---|---|---|---|---|
| 3,726,484 A | | 4/1973 | Schurr | |
| 4,056,233 A | | 11/1977 | Fay | |
| 4,248,387 A | * | 2/1981 | Andrews | 241/5 |
| 4,451,005 A | | 5/1984 | Urayama | |
| 5,547,135 A | | 8/1996 | Moriya et al. | |
| 6,196,482 B1 | * | 3/2001 | Goto | 241/39 |

FOREIGN PATENT DOCUMENTS

| | | |
|---|---|---|
| EP | 1 086 748 A1 | 3/2001 |
| GB | 636503 | 5/1950 |
| GB | 2 275 213 A | 8/1994 |
| JP | 52-044450 | 4/1977 |
| JP | 57-84756 | 5/1982 |
| JP | 63-319067 | 12/1988 |
| JP | 4-210252 | 7/1992 |
| JP | 6-254427 | 9/1994 |
| WO | WO 00/56460 | 9/2000 |

OTHER PUBLICATIONS

European Search Report dated Nov. 2, 2004.

* cited by examiner

*Primary Examiner*—Faye Francis
(74) *Attorney, Agent, or Firm*—McGuireWoods LLP

(57) ABSTRACT

A jet mill has a disk-shaped hollow part in the interior of the mill body. The hollow part is divided into an annular grinding zone for grinding a material by high-speed swirling air flows supplied through plural air nozzles and an annular classifying zone provided inside the grinding zone and communicated to an exit space for classifying the ground material by the swirling air flows in the grinding zone. An annular first constricted passageway is arranged between the grinding zone and the classifying zone to thereby divide and communicate them, and preferably an annular second constricted passageway between the classifying zone and the inside exit thereof. Accordingly, a jet mill realizing a high classification precision for a desired particle size of ground material with a narrow size distribution and having a simple inner configuration to allow easy cleaning before and after operation can be provided.

22 Claims, 6 Drawing Sheets

JET MILL

BACKGROUND OF THE INVENTION

This invention relates to a jet mill in which a high-speed air flow is supplied into a grinding chamber of a hollow part in the interior of the mill body through air nozzles inclined on the outer wall so that the coarser powder (the material to be ground) is continuously ground to fine particles (fine powder) of micron-order size in the grinding chamber while at the same time classification is effected by the swirling air flow.

In jet mills, a high-speed air flow is supplied into the grinding chamber through the air nozzles inclined on the outer wall so that the coarser material to be ground is reduced in size as it swirls and classification is also effected by the swirling air flow. Jet mills are known as grinding devices suitable for yielding superfine products (particles). They are characterized in that the interior of the grinding chamber is simple in configuration, the top and bottom surfaces of the grinding chamber are easy to separate and reassemble, and cleaning can easily be done both before and after operation.

On the other hand, the jet mill relies solely upon the air flow to grind the material in the grinding chamber, so it is difficult to grind the material to a specified particle size or control the particle size distribution to a narrow enough range. Various improvements have been attempted with a view to grinding the material to a specified particle size or narrowing the particle size distribution; three known approaches are air nozzles that permit adjustment of the angle at which the air flow is injected into the grinding chamber to enable control of the ground particle size distribution over a wide range (see, for example, JP 52-44450 A, in particular, pages 3-4 and FIGS. 2-3), a special classification mechanism such as a classification rotor provided around an exit pipe to improve classification precision (see, for example, JP 63-319067 A, in particular, pages 2-3 and FIGS. 1-3), and impact members in, for example, spherical, cylindrical or hemispherical form provided inside the grinding chamber against which the material to be ground is caused to collide with the air flow to achieve the higher grinding efficiency in the grinding chamber (see, for example, JP 57-84756 A, in particular, page 2 and FIGS. 2-3; JP 4-210252 A, in particular, pages 2-5 and FIGS. 1-2; and JP 6-254427 A, in particular, pages 3-6 and FIGS. 1-2).

However, although enabling control of the ground particle size distribution over a wide range, the swirling fluid-energy mill disclosed in JP 52-44450 A suffers from a problem of a poor classification precision, since the mill injects compressed air to grind a material and at the same time forms swirling flow to perform classification, thereby also ejecting yet large particles.

And, the horizontal swirling flow jet mill disclosed in JP 63-319067 A, while resolving the problem of a poor classification precision of the mill of JP 52-44450 A, has problems such as that a turbulence is generated in swirl and that fine particles adhere to the rotor wall, due to a difference in speed between the swirling flow formed by the compressed air and that formed by the classification rotor.

Furthermore, the jet mills disclosed in JP 57-84756 A, JP 4-210252 A and JP 6-254427 A, while improving the grinding efficiency, have problems such as that the impact member obstructs the air flow, generating a significant turbulence in the swirling flow to thereby lower the classification precision or to allow the ground material to heavily adhere to the impact member, resulting in difficulty with a stable (continuous) operation.

Moreover, these prior arts all require that complexly shaped mechanical parts be additionally provided inside the grinding chamber, as exemplified by the special mechanism for adjusting the angle at which the air flow is injected, the special mechanism for classification, and the special impact members provided inside the grinding chamber. These compromise the three advantageous features of the jet mill, that is, the interior of the grinding chamber is simple in configuration, the top and bottom surfaces of the grinding chamber are easy to separate and reassemble, and cleaning can easily be done both before and after operation. Therefore, the aforementioned prior arts have not been completely satisfactory.

SUMMARY OF THE INVENTION

The present invention has been accomplished under these circumstances and has as an object providing a jet mill that solves the aforementioned problems of the prior art by ensuring that fine particles obtained by the grinding process has the desired particle size with a narrower size distribution of a higher classification precision and which still retains the three advantageous features of the jet mill, that is, the interior of the grinding chamber is simple in configuration, the top and bottom surfaces of the grinding chamber are easy to be separated and reassembled, and cleaning can easily be done both before and after operation.

In order to attain the object described above, a first aspect of the present invention provides a jet mill comprising a jet mill body forming a disk-shaped hollow part (a grinding chamber) inside thereof and having an annular outer wall; plural air nozzles generating high-speed air flow in the disk-shaped hollow part and being inclined on the annular outer wall with respect to a center of the disk-shaped hollow part; and an exit port being provided in a substantially central area of the disk-shaped hollow part of the jet mill body, wherein the hollow part comprises an annular grinding zone that is provided inside the annular outer wall and where a material to be ground is milled by means of the high-speed air flow supplied through the plural air nozzles; an annular classifying zone that is provided inside the annular grinding zone and communicates with a space of the exit port and where the milled material is classified by means of the high-speed air flow that is positioned inward of the annular grinding zone; and a first annular constricted passageway that is provided between the annular grinding zone and the annular classifying zone and that generally divides the hollow part into the annular grinding zone and the annular classifying zone, wherein the annular grinding zone and the annular classifying zone communicate by means of the first annular constricted passageway.

Preferably, the jet mill body further comprises an upper casing shaped substantially like a disk; and a lower casing shaped substantially like a disk, wherein the annular outer wall is disposed between the upper casing and the lower casing, and wherein the disk-shaped hollow part is an interior space formed between the upper casing and the lower casing, and inside the annular outer wall.

And, preferably, the first annular constricted passageway is formed between a top surface and a bottom surface of the disk-shaped hollow part to give a first predetermined spacing.

Preferably, the first annular constricted passageway is an annular channel (classification ring channel) formed between annular barriers that are mounted on a top surface and a bottom surface of the disk-shaped hollow part, respectively giving a second predetermined spacing at a predetermined position in a radius direction of the hollow part.

And, preferably, the annular grinding zone is an interior space where a distance between a top surface and a bottom surface of the disk-shaped hollow part is narrowed toward the center so that the top surface and the bottom surface of the hollow part approach asymptotically to each other toward the center, and wherein the first annular constricted passageway is an annular channel formed between first and second annular projecting portions of the top surface and the bottom surface of the disk-shaped hollow part that are mounted, respectively giving a second predetermined spacing at a predetermined position in a radius direction of the hollow part.

In order to attain the object described above, a second aspect of the present invention provides the jet mill according to the first aspect of the present invention and further comprising a second annular constricted passageway that is provided between the classifying zone and the exit port provided inside the classifying zone and that generally divides the hollow part into the classifying zone and the space of the exit port, wherein the classifying zone and the space of the exit port communicate by means of the second annular constricted passageway.

Preferably, the second annular constricted passageway is formed between a top surface and a bottom surface of the disk-shaped hollow part, giving a third predetermined spacing.

And, preferably, the exit port is formed by means of an exit pipe provided in the substantially central area of the disk-shaped hollow part of the jet mill body so as to extend toward an upper side or a lower side, and wherein the second annular constricted passageway is an annular channel formed between a third annular projecting portion at a lower end of the exit pipe extending toward the upper side and a disk or a fourth annular projecting portion in short tubular form that is provided on an upper side of the bottom surface of the hollow part, or the third annular projecting portion at an upper end of the exit pipe extending toward the lower side and the disk or the fourth annular projecting portion in short tubular form that is provided on a lower side of the top surface of the hollow part, and wherein the third annular projecting portion and the disk or the fourth annular projecting portion are provided, giving a fourth predetermined spacing.

That is, preferably, the second annular constricted passageway (exit ring channel) is formed such that the third annular projecting portion at a lower end of the exit pipe provided in a substantially central area of the hollow part in the jet mill body, extending toward the upper side and the disk or the fourth annular projecting portion in short tubular form that is provided on an upper side of the bottom surface in the substantially central area of the hollow part are provided at a specified distance from each other, or the third annular projecting portion at an upper end of the exit pipe provided in a substantially central area of the hollow part in the jet mill body, extending toward the lower side and the disk or the fourth annular projecting portion in short tubular form that is provided on a lower side of the top surface in the substantially central area of the hollow part are provided at a specified distance from each other.

And, preferably, the exit pipe is movable in a vertical direction with respect to the jet mill body, and wherein a width (a gap length) of the second annular constricted passageway is adjusted by moving the exit pipe in the vertical direction to move the third annular projecting portion toward or away from the disk or the fourth annular projecting portion.

And, preferably, the exit port is formed by means of an exit pipe provided in the substantially central area of the disk-shaped hollow part of the jet mill body so as to extend toward an upper side or a lower side, and wherein the second annular constricted passageway is an annular channel formed between a third annular projecting portion at a lower end of the exit pipe extending toward the upper side and a fifth annular projecting portion that is provided on an upper side of the bottom surface of the hollow part, or the third annular projecting portion at an upper end of the exit pipe extending toward the lower side and the fifth annular projecting portion that is provided on a lower side of the top surface of the hollow part, and wherein the third annular projecting portion and the fifth annular projecting portion are provided to give a fourth predetermined spacing.

And, preferably, the exit pipe and one of an upper casing and a lower casing of the jet mill body are formed in an integral form, both of the upper casing and the lower casing being shaped substantially like a disk, and wherein the disk-shaped hollow part is an interior space formed between the upper casing and the lower casing, and inside the annular outer wall.

As described below in detail, the jet mill of the present invention has a first annular constricted passageway (classification ring channels) and more preferably further has a second annular constricted passageway (exit ring channel) and, as a result, it is characterized by ensuring that fine particles has the desired particle size with a narrower size distribution and which still retains the three advantageous features of the jet mill, that is, the interior of the grinding chamber is simple in configuration, the top and bottom surfaces of the grinding chamber are easy to separate and reassemble, and cleaning can easily be done both before and after operation.

This application claims priority on Japanese patent applications No.2003-313624 and No. 2003-352312, the entire contents of which are hereby incorporated by reference.

DESCRIPTION OF THE PREFERRED EMBODIMENTS

On the pages that follow, the jet mill of the invention is described in detail with reference to the preferred embodiments shown in the accompanying drawings.

Figure 1:
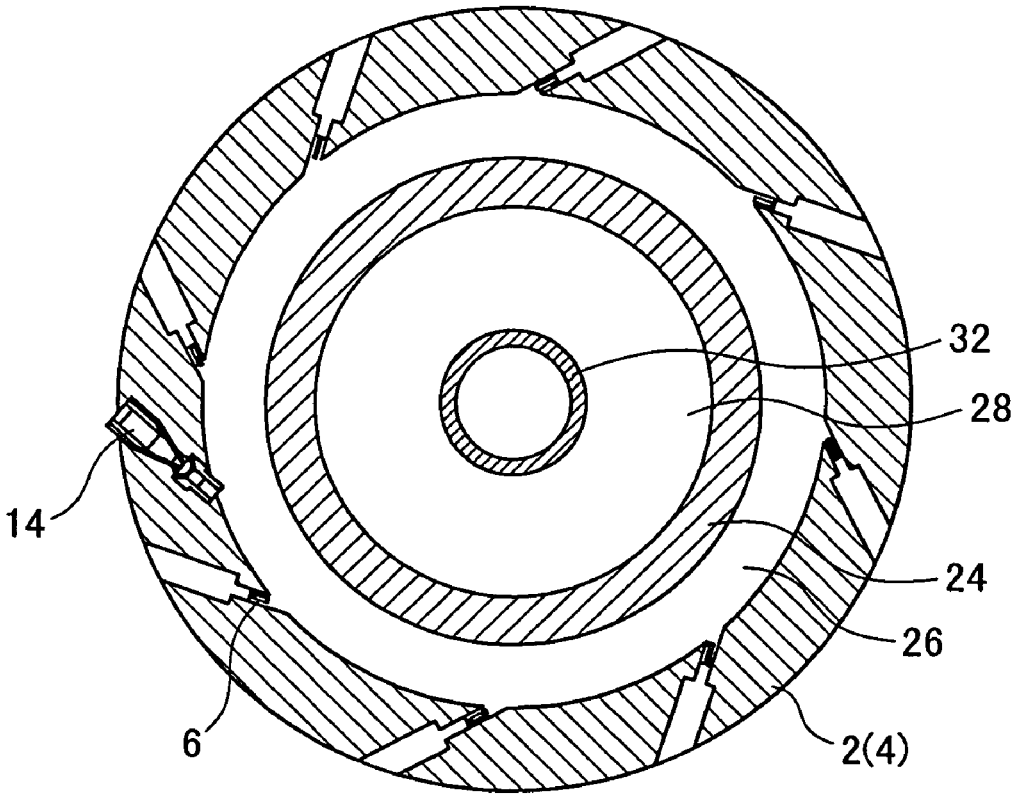
FIG. 1 is a cross-sectional view showing in concept the configuration of a jet mill according to an embodiment of the invention.
Figure 2:
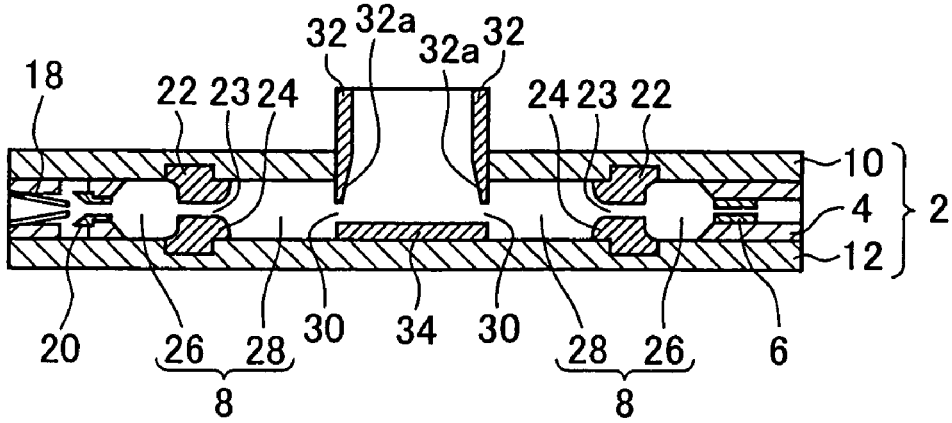
FIG. 2 is a side section of the jet mill shown in FIG. 1.

FIG. 1 is a cross-sectional view showing in concept the configuration of the jet mill according to a first embodiment of the invention; FIG. 2 is a side section of the jet mill shown in FIG. 1; and FIG. 3 is a side-sectional view showing details of a specific configuration of the jet mill of the embodiment.

Figure 3:
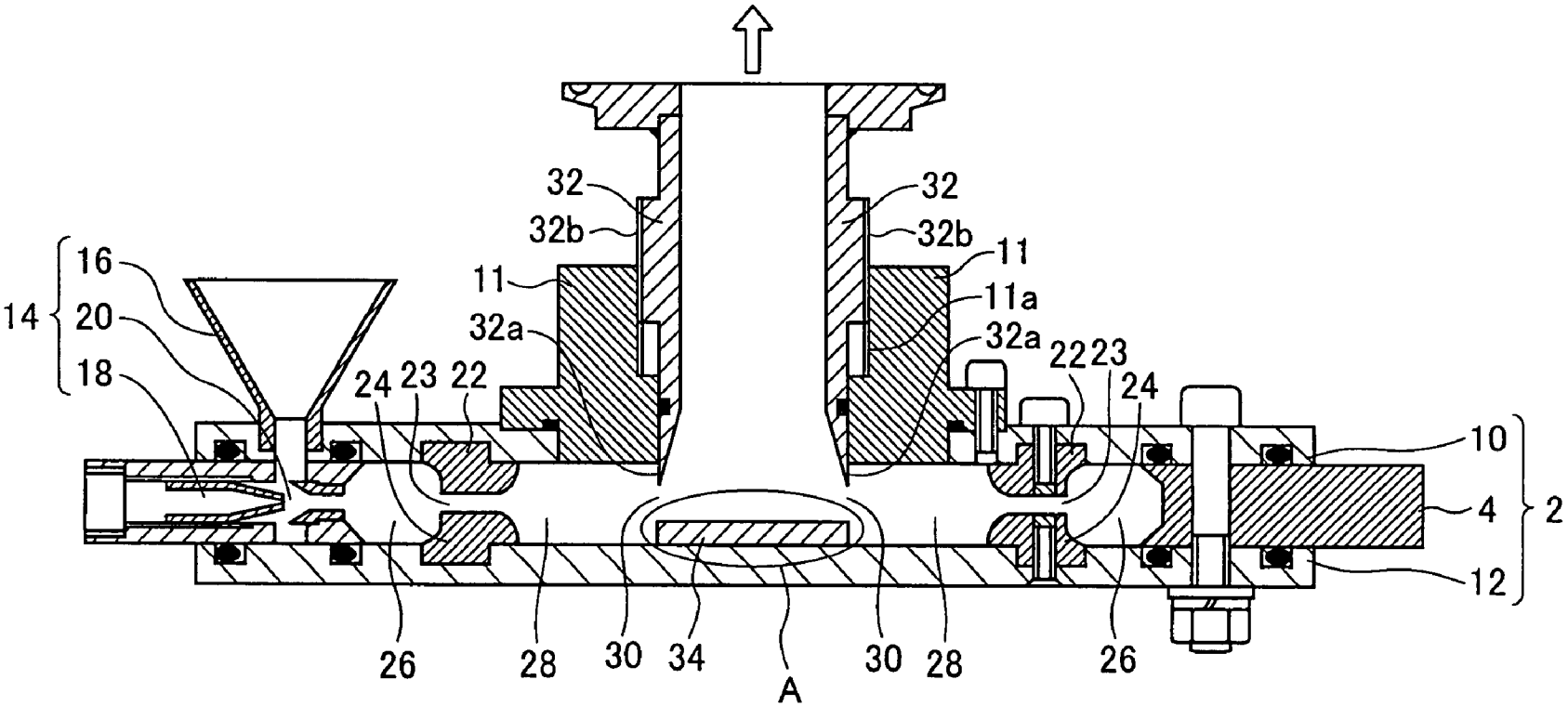
FIG. 3 is a side-sectional view showing details of a specific configuration of the jet mill shown in FIG. 1.

As shown in FIGS. 1 to 3, the jet mill according to the first embodiment of the invention comprises a mill body 2 like a disk (a cylindrical or a hollow disk shape) having air nozzles 6 inclined on an annular (or cylindrical) outer wall 4 with respect to the tangent (or center line) thereof, through which a high-speed air flow is supplied inward to grind a material in a grinding chamber 8 in the mill body 2. The grinding chamber 8 is formed as a hollow portion (inner space) like a shallow disk (annularly doughnut-shape or cylindrical shape) inside the mill body 2 that is defined by a disk-shaped top plate 10 (upper casing) and a disk-shaped bottom plate 12 (lower casing), and by the outer wall 4 and an exit pipe 32, all four being the components of the mill body 2. As shown specifically in FIG. 3, the top plate 10 and the bottom plate 12 as well as the outer wall 4 are sealed with sealants such as O-rings to ensure that neither air nor the fine particles of the ground material will not leak to the outside.

As shown in FIG. 1, the air nozzles 6 are equidistantly spaced and inclined on the annular outer wall 4 of the mill body 2 with respect to the tangent thereof; the air flow as supplied through these air nozzles 6 is rapidly blown inside the grinding chamber 8, mostly whose shearing force grinds the material. Moreover, as the air flow swirls inside the grinding chamber 8 rapidly, the material to be ground supplied into the grinding chamber 8 also swirls rapidly and the resulting swirling motion causes the particles of the material to collide either against themselves or against the wall surfaces of the grinding chamber 8, whereby the material is also ground and reduced in size.

The compressed air is supplied from its source (not shown) via conduits (also not shown). As the compressed air passes through the air nozzles 6, it is throttled to produce a high-speed air jet which is forced into the interior of the grinding chamber 8. The inclined air nozzles 6 on the outer wall 4 preferably form, with a tangent to the annular outer wall 4, an angle of 10-50 degrees (80-40 degrees with the center line), more preferably 20-40 degrees (70-50 degrees with the center line). The number of air nozzles 6 is preferably at least four. While the pitch on which the air nozzles 6 are to be provided on the outer wall 4 varies with the size of the mill body 2, it preferably does not exceed about 160 mm. For grinding the material to finer particles, it is preferred to provide a larger number of air nozzles 6 on the outer wall 4.

The material to be ground is supplied through a feed inlet 14 which is inclined at generally the same angle as the air nozzles 6 with respect to the outer wall 4 of the mill body 2. In the embodiment under consideration, the feed inlet 14, as shown in detail in FIG. 3, consists of a funnel 16 through which the material to be ground is fed, a supply nozzle 18 through which air is supplied to carry the material into the grinding chamber 8, and a diffuser 20 in which the material fed through the funnel 16 is mixed with the air supplied through the supply nozzle 18 and supplied to the interior of the grinding chamber 8. A metered quantity of the material to be ground is fed into the funnel 16 from its supply unit not shown.

The material fed into the funnel 16 is carried by the high-speed air flow blown from the supply nozzle 18 and passes through the diffuser 20 to be fed to the interior of the grinding chamber 8. The material fed into the grinding chamber 8 is ground mainly by the high-speed air flow jetted by the air nozzles 6 and carried by both the air flow forced out of the diffuse 20 together with the material and the air flow supplied through the air nozzles 6 and swirls at high speed inside the grinding chamber 8 so that the particles of the material collide either against themselves or against the inner wall surfaces of the grinding chamber 8, whereby the material is ground into fine particles (fine power).

In the jet mill according to the embodiment under consideration, the grinding chamber 8 is formed as an annularly doughnut-shaped hollow part and two classification rings 22 and 24 are formed as annular barriers inside the grinding chamber 8 in a position substantially halfway the width in the radius direction, whereby the grinding chamber 8 is split into two annular parts, an outer (doughnut-shaped) grinding zone 26 and an inner (doughnut-shaped) classifying zone 28. A first constricted passageway that characterizes the invention is formed between the classification rings 22 and 24 as a classification ring channel 23, communicating the split tow parts of grinding zone 26 and classifying zone 28. The classification rings 22 and 24 which provide the annular barriers are spaced apart on the top and bottom surfaces of the grinding chamber 8 formed as a hollow portion inside the mill body 2 such that the upper classification ring 22 is fixed on the top plate 10 of the mill body 2 and the lower classification ring 24 which is of the same diameter and in a generally symmetrical shape is fixed on the bottom plate 12 of the mill body 2 at a given spacing from the upper classification ring 22 (the opening width of the classification ring channel 23); thus, the classification rings 22 and 24 serve as annular barriers that split the interior of the grinding chamber 8 into the outer grinding zone 26 and the inner classifying zone 28 as well as communicate them.

More particularly, the classification ring channel 23 as a constricted passageway of the present invention is formed of a spacing between the classification rings 22 and 24 that serve as annular barriers on the top and bottom surfaces of the grinding chamber 8. The classification ring channel 23 communicates the grinding zone 26 and the classifying zone 28 which are divided by the classification rings 22 and 24.

In the present invention, the classification rings 22 and 24 may be replaced with various replacements which are prepared in advance to give different spacings (opening widths of the classification ring channel 23). The classification rings 22 and 24 provided in the grinding chamber 8 of the mill body 2 are replaced with such replacements so that the distance between the classification rings 22 and 24 (the opening width of the classification ring channel 23) can be readily adjusted to provide an appropriate spacing in accordance with a material to be ground and the like.

In order to ensure that the particles of the material after collision are positively returned to the grinding zone 26 of the grinding chamber 8, the classification rings 22 and 24 provided in the grinding chamber 8 have wall surfaces which face the grinding zone 26 are preferably so shaped as to be curved toward the center of the wall surfaces in a convex shape at the corners or otherwise inclined toward the center of the wall surfaces, as shown in FIGS. 2 and 3.

Further, in order to ensure that the ground material after passing through the classification ring channel 23 between the classification rings 22 and 24 smoothly flows into the classifying zone 28, the classification rings 22 and 24 have wall surfaces which face the classifying zone 28 are preferably so shaped as to be curved toward the center of the wall surfaces in a convex shape at the corners or otherwise inclined toward the center of the wall surfaces, as shown in FIGS. 2 and 3.

The jet mill of the invention also has an exit ring channel 30 provided inward of the classifying zone 28. In the embodiment under consideration, the exit ring channel 30 consists of an exit pipe (a circular tube) 32 provided through the center of the top plate 10 of the grinding chamber 8, with a projecting portion 32*a* at the lower end, and a disk 34 having substantially the same diameter as that of the lower end of the exit pipe 32 and provided at the center of the bottom plate 12 of the grinding chamber 8. The lower end of the projecting portion 32*a* of the exit pipe 32 is spaced from the top surface of the disk 34 by a given spacing; the spacing between them constitutes the exit ring channel 30.

Speaking further of the projecting portion 32*a* at the lower end of the exit pipe 32 provided through the center of the top plate 10 which forms the grinding chamber 8, the amount of projection of the projecting portion 32*a* into the grinding chamber 8 (the classifying zone 28) can be adapted to be variable such that the opening width of the exit ring channel 30 can be adjusted. To illustrate a specific example of such design by reference to FIG. 3, the upper casing of the mill body 2 is constituted of the annular top plate 10 and a support block 11 attached to the top plate 10 to support the exit pipe 32 movably in a vertical direction. Being provided with an internal screw thread 11*a* in the support block 11 to be screwed with a height adjusting thread 32*b* formed on an outer circumferential surface of the exit pipe 32, the exit pipe 32 is rotated such that the height adjusting thread 32*b* formed on the outer circumferential surface of the pipe 32 is moved forward or backward with respect to the internal screw thread 11*a* of the support block 11 being threaded thereto, and thus the exit pipe 32 moves vertically, allowing the projecting portion 32*a* at the lower end of the exit pipe 32 to project into the grinding chamber 8 (the classifying zone 28) by a desired amount (from the inner wall surface at the lower side or the lower end of the support block 11). Thus, the opening width (spacing) of the exit ring channel 30 is made adjustable.

Figure 4A:
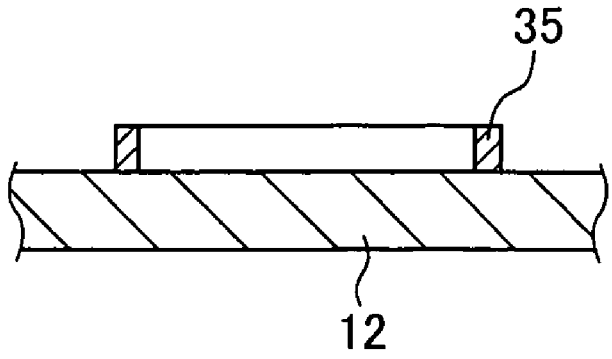
FIG. 4A is a sectional view that illustrates the essential part of another structural design of an exit ring channel forming member by showing details of the portion enclosed with circle A in FIG. 3.
Figure 4B:
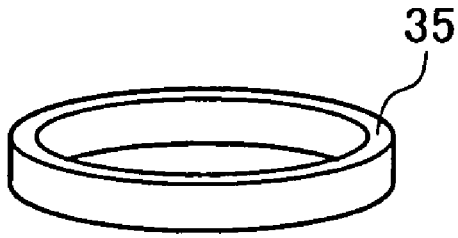
FIG. 4B is a perspective view of the exit ring channel forming member.

The design of the exit ring channel 30 is by no means limited to the combination of the projecting portion 32*a* of the pipe 32 which protrudes into the grinding chamber 8 from its top plate 10 and the disk 34 fixed to the center of the bottom plate 12 of the grinding chamber 8. The disk 34 may be replaced by any suitable member which, as shown in FIGS. 4A and 4B, consists of a projection in short circularly tubular form (a short circular tube) 35 that is provided at the center of the bottom plate 12 of the grinding chamber 8.

In addition, the top plate 10, the outer wall 4 and the bottom plate 12 are fixed by fixtures such as plural bolts with nuts and screws, fixing the top plate 10, the outer wall 4 and the bottom plate 12 from outside thereof at plural sites; and the support block 11 may be fixed to the top plate 10, the classification ring 22 to the top plate 10 and the classification ring 24 to the bottom plate 12 by fixtures such as plural bolts with nuts and screws.

Described above is the configuration of the jet mill according to the embodiment under consideration. The material to be ground is fed into the outer grinding zone 26 of the grinding chamber 8, is mainly ground by the high-speed air flow jetted by the air nozzles 6 and carried by both the air flow supplied by the supply nozzle 18 and forced out of the diffuser 20 together with the material and the air flow supplied through the air nozzles 6, and swirls at high speed inside the grinding zone 26 of the grinding chamber 8 so that the particles of the material collide either against themselves or against the inner wall surfaces in the grinding zone 26 of the grinding chamber 8, whereby the material is ground into fine particles (fine power).

The fine particles ground to the desired size is suspended in the air flow swirling inside the grinding chamber 8 and flows into the classifying zone 28 of the grinding chamber 8 as it is carried by the air flow ejected from the grinding zone 26 through the classification ring channel 23 which is a gap distance between the classification rings 22 and 24. The coarser particles of the material are subject to the greater centrifugal force created by the swirling air flow, so they remain in the grinding zone 26 whereas the fine particles ground to the intended size and less flows into the classifying zone 28 through the classification ring channel 23. The fine particles of the material flowing into the classifying zone 28 are suspended in the air flow swirling inside of it which is more rectified than the air flow swirling in the grinding zone 26, and the particles are ground to fall in a predetermined particle size distribution and are ejected through the exit ring channel 30 to the outside together with the air flow flowing out of the exit pipe 32 to be collected as final product of fine particles, leaving behind the concomitant coarser particles of the material.

To be noted that at the classification ring channel 23 formed of a distance between the classification rings 22 and 24, fine particles of the material are classified by equilibrium between a centrifugal force ($m*Vt^2/r$, wherein m refers to a mass of particles, Vt to a speed of particles in the center line direction, and r to a radius) and an air drag force (A*dp*Vr, wherein A refers to a coefficient, dp to a particle size, and Vr to a speed of particles in the center line direction). Larger the distance between the classification rings 22 and 24 is, larger the opening width of the classification ring channel 23 becomes, i.e., larger the sectional area of the passage becomes, resulting in the slower speed (Vt) of the air flowing into the center. Here, the relation between the centrifugal force and the air drag force is expressed as centrifugal force>air drag force, resulting in the smaller classification point, thereby obstructing particles of the material to pass through the classification ring channel 23. This illustrates how a particle size of ground particles (fine powder) can be controlled by altering the distance between the classification rings 22 and 24 (opening width of the classification ring channel 23).

If the grinding chamber 8 is provided with a classification ring channel 23 formed by the classification rings 22 and 24, although the fine particles ground inside and ejected from the jet mill would have a small particle size, an amount of particles with smaller sizes than the desired size would increase as well as an amount of coarse particles (isolated coarse particles) would also increase, so the particle size distribution would be broader. In other words, without a classification ring channel 23, it is unlikely to form a uniform swirling flow over an entire area in a radius direction and a height direction in the grinding zone 26 to thereby generate both particles being easily ejected and being hardly ejected, resulting in the broader particle size distribution. Furthermore, a lot of particles are often deposited between the air nozzles 6 in the grinding chamber 8; too much of particle deposition may obstruct continuous operation of the jet mill.

On the contrary, being provided with the classification ring channel 23 formed by the classification rings 22 and 24, the present invention is capable of efficiently ejecting fine particles of the intended particle size from the grinding zone 26, and therefore, over-grinding of a material can be prevented, suppressing generation of finer particles than the intended particle size. Moreover, the present invention may form uniform flow lines both in the grinding zone 26 and the classifying zone 28 and prevent the mixing of the coarse particles into the final product of fine particles. As a result, the present invention is capable of obtaining a sharp particle distribution.

The fine particles ejected to the outside together with the air flow coming out of the exit pipe 32 are of micron-order size and may be trapped with a suitable trapping device such as a cyclone or bag filter (not shown), whereby a fine product can be obtained as finely ground particles which are precisely classified into a uniform particle size distribution.

The particles flowing into the classifying zone 28 swirl inside of it a number of times and, as a result, those particles which are virtually equal to fines flow out of the apparatus together with the exiting air flow whereas the coarser particles go back and forth between the classifying zone 28 and the grinding zone 26, thereby being ground every time coming into the grinding zone 26. This provides a multistage grinding and classification effect, permitting classification of higher precision.

In order to compare the above-described jet mill of the invention with a prior art jet mill, the following comparative experiment was conducted. The two jet mills employed in the experiment were such that the grinding chamber 8 had an inside diameter of 160 mm, with the side-sectional shape shown in FIG. 3, and had eight air nozzles 6 provided equidistantly on the outer wall 4 as shown in FIG. 1, with the material to be ground being supplied through the feed inlet 14.

EXAMPLE 1

Polyester-based nonmagnetic color toner particles with an average size of 500 μm was ground with the jet mill shown in FIGS. 1 to 3, and the effectiveness of a classification ring channel 23 formed by classification rings 22 and 24 as annular barriers in the process of grinding was evaluated. Compressed air was supplied through the air nozzles 6 at a pressure of 0.6 MPa and the feed was supplied at a rate of 800 g/hr. The fine particles obtained by the grinding process had an average particle size of 6.4 μm, with the volume fraction of particles finer than 3 μm being 3.9% and that of particles coarser than 10 μm being 1.8% in the presence of the classification ring channel 23. At this time, the mill body 2 had a diameter of 285 mm; the gap spacing between the top plate 10 and the bottom plate 12, that is, the height of the grinding chamber 8, was 20 mm; and the distance between the classification rings 22 and 24 (the opening width of the classification ring channel 23) was 4 mm.

COMPARATIVE EXAMPLE 1

On the other hand, in Example 1 described above but without the classification ring channel 23 formed by the classification rings 22 and 24 as annular barriers, the fine particles obtained by the grinding process had an average particle size of 6.2 μm, with the volume fraction of particles finer than 3 μm being 6.3% and that of particles coarser than 10 μm being 4.2%.

Thus, by providing the classification ring channel 23 formed by the classification rings 22 and 24 in the present invention, the average particle size of the fine particles obtained by the grinding process slightly increased from 6.2 μm to 6.4 μm but, on the other hand, the volume fraction of the particles finer than 3 μm decreased significantly from 6.3% to 3.9% and that of the particles coarser than 10 μm from 4.2% to 1.8%. Obviously, the slight increase in the average particle size of the fine particles obtained by the grinding process was compensated by the marked improvement in the size distribution.

EXAMPLE 2

As in Example 1, polyester-base nonmagnetic color toner particles having an average size of 500 μm were fed as the material to be ground and the grinding process was performed with the distance between the classification rings 22 and 24 (the opening width of the classification ring channel 23) being varied. The average size of the fine particles obtained by the grinding process was measured. Compressed air was supplied through the air nozzles 6 at a pressure of 0.5 MPa and the feed was supplied at a rate of 500 g/hr. The fine particles obtained by the grinding process had average particle sizes of 7.3 μm, 6.3 μm and 5.8 μm with distance between the classification rings 22 and 24 adjusted to 4 mm, 6 mm and 18 mm, respectively.

Obviously, the average size of the fine particles obtained by the grinding process decreased as the distance between the classification rings 22 and 24 (the opening width of the classification ring channel 23) was increased and vice versa. Thus, it was verified that by changing the distance between the classification rings 22 and 24, the average particle size of the fine particles obtained by the grinding process can be controlled.

If a classification ring channel 23 is not formed in the grinding chamber 8, although an average particle size of the ground fine particle to be ejected from the jet mill becomes small, amounts of particles with smaller sizes than the desired particle size as well as of coarse particles (isolated coarse particles) increase, resulting in the broader particle size distribution, as stated above.

EXAMPLE 3

As in Example 1, polyester-based nonmagnetic color toner particles having an average size of 500 μm were ground but this time for the purpose of evaluating the effectiveness of the exit ring channel 30 in the process of grinding with jet mills. In this experiment, compressed air was supplied through the air nozzles 6 at a pressure of 0.5 MPa and the feed was supplied at a rate of 500 g/hr. When the jet mill had the exit ring channel 30 as in the invention, the fine particles obtained by the grinding process had an average particle size of 7.3 μm, with the volume fraction of particles coarser than 10 μm being 5.2% and that of particles coarser than 16 μm being 0.0%.

On the other hand, without the exit ring channel 30, the fine particles obtained by the grinding process had an average particle size of 10.7 μm, with the volume fraction of particles coarser than 10 μm being 56.6% and that of particles coarser than 16 μm being 5.0%.

Thus, by providing the exit ring channel 30, the average particle size of the fine particles obtained by the grinding process decreased from 10.7 μm to 7.3 μm and, in addition, the volume fraction of the particles coarser than 10 μm decreased dramatically from 56.6% to 5.2% and that of the particles coarser than 16 μm from 5.0% to 0.0%. Obviously, by providing the exit ring channel 30, the average particle size of the fine particles was reduced and, at the same time, the size distribution was improved markedly.

The foregoing phenomenon may be explained as follows: without the exit ring channel 30, the relative speed of the air flow passing through the classification ring channel 23 between the classification rings 22 and 24 to move from the grinding zone 26 into the classifying zone 28 increases so much that even particles of larger size are suspended in that air flow (and pass through the classification ring channel 23) but this is effectively prevented by providing the exit ring channel 30.

The jet mill of the first embodiment shown in FIGS. 1 to 4 comprises the mill body 2 of a hollow disk, in which a cylindrical (ring-doughnut shaped) hollow part is formed between the disk-shaped top plate 10 and bottom plate 12, and between the annular outer wall 4 and the exit pipe 32 as the grinding chamber 8. The classification rings 22 and 24 are provided in the grinding chamber 8 to split the grinding chamber 8 into the outer ring-doughnut shaped grinding zone 26 and the inner ring-doughnut shaped classifying zone 28, forming an annular gap spacing of the first constricted passageway as the classification ring channel 23. Preferably, the disk 34 is provided at the center of the bottom plate 12 to form an annular gap spacing of the second constricted passageway as the exit ring channel 30 between the projecting portion 32*a* of the exit pipe 32 and the disk 34. However, the present invention is by no means limited to this embodiment. The jet mill may be of any construction as long as two hollow parts are formed outside and inside of the first annular constricted passageway as the grinding zone 26 and the classifying zone 28, respectively, in the mill body 2, and preferably, the second constricted passageway is formed between the classifying zone 28 and the space in the exit pipe 32.

Figure 5:
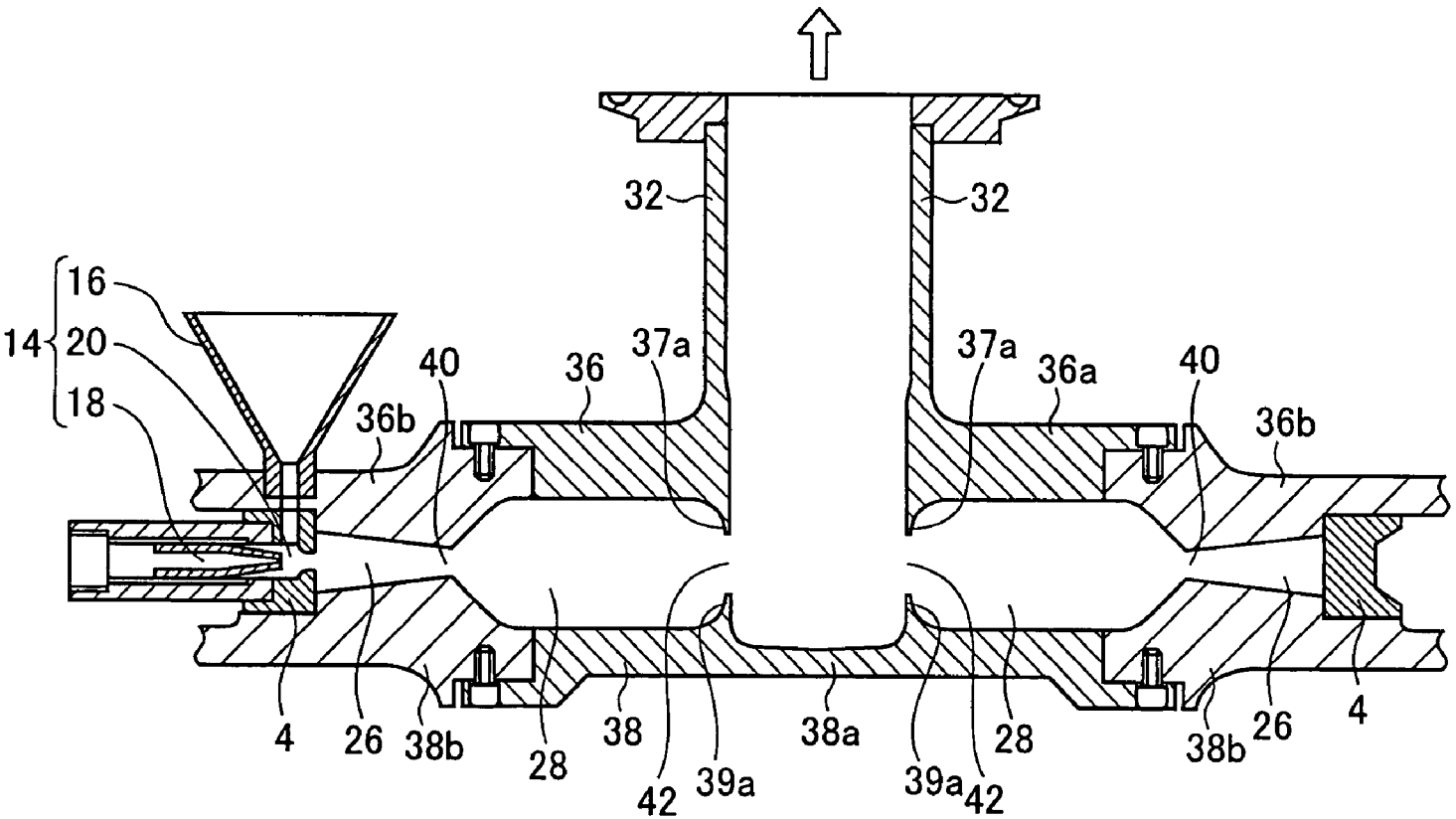
FIG. 5 is a side-sectional view showing in concept a jet mill according to an embodiment of the invention, having an improved specific configuration.

FIG. 5 shows a second embodiment which modifies the jet mill according to the first embodiment shown in FIGS. 1-4 by significantly decreasing the number of parts and at the same time forming the classification ring channel 40 as the first constricted passageway between the annular outer wall 4 and the exit pipe 32 and between the top block (upper casing) 36 and the bottom block (lower casing) 38 to split the chamber 8 into the grinding zone 26 and the classifying zone 28, and the exit ring channel 42 as the second constricted passageway to divide the classification zone 28 from the space in the exit pipe 32. In other words, the jet mill according to the second embodiment shown in FIG. 5 provides a classification ring channel 40 as a first constricted passageway of the invention formed of projecting portions of the top block 36 and the bottom block 38, respectively, having the more gentle shape than that of the classification ring channel 23 formed of the classification rings 22 and 24 according to the first embodiment. The grinding zone 26, the classification channel 40 and the classifying zone 28 form a hollow part shaped like a disk (an inner space corresponding to the grinding chamber 8 of the first embodiment shown in FIG. 1) between the outer wall 4 and the exit pipe 32, and between the top block 36 and the bottom block 38.

The classification ring channel 40 as the first constricted passageway in the first embodiment corresponds to the classification ring channel 23 in the first embodiment.

Compared to the classification ring channel 23 in the first embodiment, the classification ring channel 40 provides ease in forming a smooth (that is, mildly changing) barrier (i.e., constricted passageway) and offers the advantage of facilitating size adjustment in the grinding of the feed.

Formed outside the classification ring channel 40 is the annular grinding zone 26 and formed inside it is the annular classifying zone 28. The grinding zone 26 has an inner wall surface of the top block 36 (an upper surface of a hollow part shaped like a disk) and an inner wall surface of the bottom block 38 (a lower surface of the space) coming gradually close to each other toward the center; thus, the inner space (the hollow part) between them is designed so as to become gradually and smoothly narrower toward the center of the jet mill. More particularly, the classification ring channel 40 is an annular channel formed between the projecting portion of the inner surface of the top block 36 (the upper surface of the hollow part) and the projecting portion of inner surface of the bottom block 38 (the lower surface of the hollow part) provided respectively with a given spacing at predetermined locations in the radius direction of the hollow part shaped like a disk, where the distance between both projecting portions is smallest.

And, provided between the classifying zone 28 and the exit space inside the exit pipe 32 is the exit ring channel 42 as a second constricted passageway formed by the opposing portions of the top block 36 and the bottom block 38. The exit ring channel 42 has the same function as the exit ring channel 30 in the first embodiment.

Thus, in the jet mill according to the embodiment shown in FIG. 5, the lower end portion 37*a* of the top block 36 which is formed of the top block 36 and the exit pipe 32 integrally and corresponds to the lower end portion of the exit pipe 32 combines with an annular projecting portion 39*a* at the center of the bottom block 38 which is provided correspondingly thereto to comprise an exit ring channel 42 that is equivalent to the exit ring channel 30 in the first embodiment.

Again, the exit ring channel 42 is preferably adapted such that its lower end portion 37*a* of the top block 36 or the annular projecting potion 39*a* of the bottom block 38 is adjustable in position, allowing the opening width of the exit ring channel 42 to be made adjustable.

In the example shown in FIG. 5, the top block 36 is designed to be dividable into a top center block 36*a* formed integrally with the exit pipe 32 and an annular top outside block 36*b*. The bottom block 38 is designed to be dividable into a disk-shaped bottom center block 38*a* corresponding to the top center block 36*a* and an annular bottom outside block 38*b* outside thereof corresponding to the top outside block 36*b*. The top center block 36*a* and the bottom center block 38*a* mainly form the classifying zone 28, the exit ring channel 42 and the exit space of the exit pipe 32, while the top outside block 36*b* and the bottom outside block 38*b* mainly form the grinding zone 28 and the classification ring channel 40.

In such design, having beforehand various sets of top center block 36*a* and bottom center block 38*a* as well as various sets of top outside block 36*b* and bottom outside block 38*b*, respectively corresponding to each other, altering at least either one of the top center block 36*a* and the bottom center block 38*a*, the opening of the exit ring channel 42 is allowed to be easily adjusted to the desired width, and by altering at least either one of the top outside block 36*b* and the bottom outside block 38*b*, the opening of the classification ring channel 40 is allowed to be easily adjusted to the desired width.

Compared to the jet mill according to the first embodiment previously shown in FIGS. 1 to 4, the one of the second embodiment shown in FIG. 5 is composed of such a smaller number of parts that it can be fabricated with ease and yet it has comparable capabilities to the jet mill according to the first embodiment.

Figure 6:
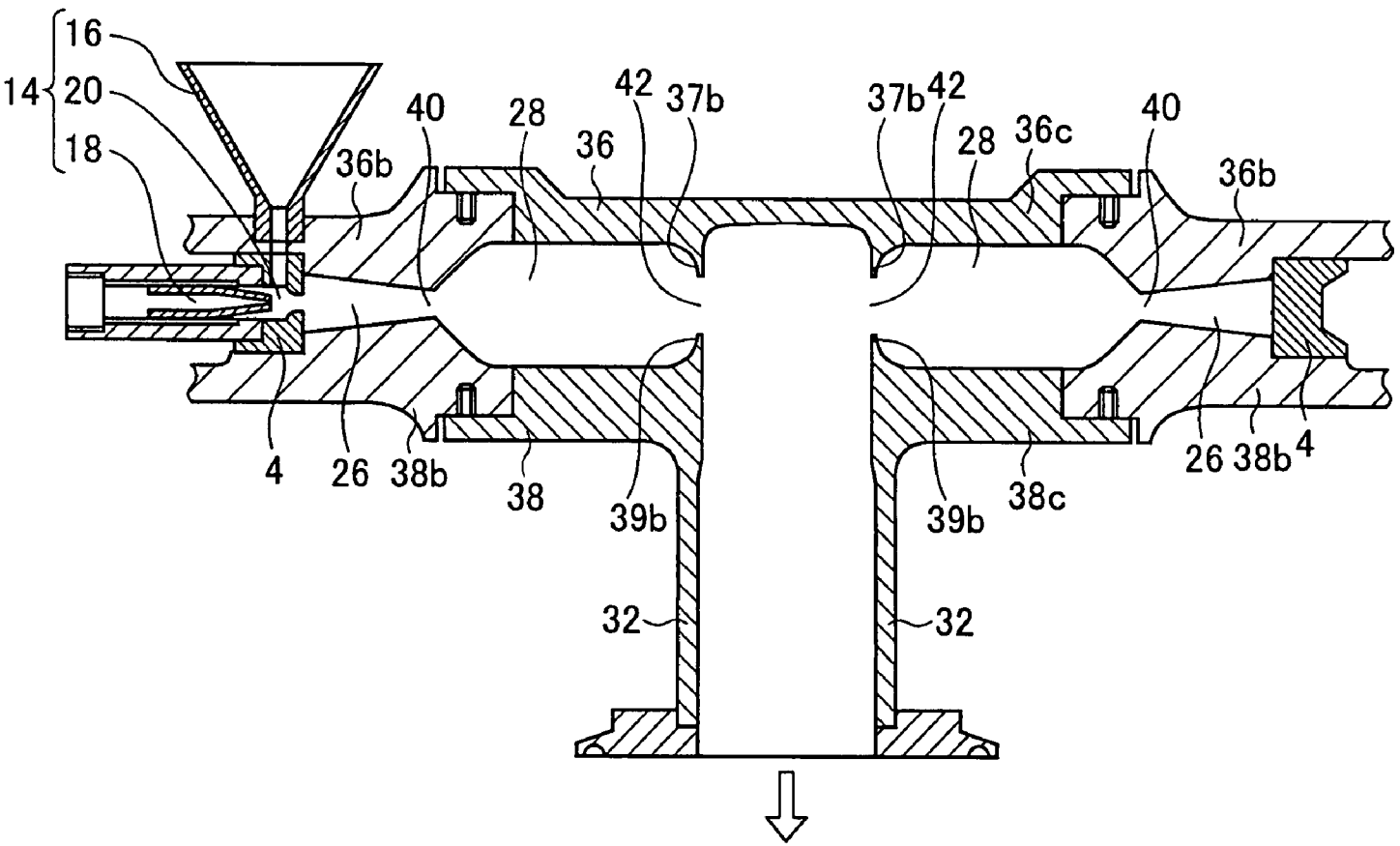
FIG. 6 is a side-sectional view showing in concept a jet mill according to another embodiment of the invention, having another improved specific configuration.

And, one modified design in the second embodiment of the present invention is shown in FIG. 6, where the final product of fine particles following the grinding process is withdrawn downward through the exit pipe 32 extending from the mill body. This design often provides ease in subsequent handling of the product of fine particles. To be noted that in the jet mill shown in FIG. 6, the top center block 36*a* and the bottom center block 38*a* corresponding to each other shown in FIG. 5 are replaced upside-down so as to be used as the bottom center block 38*c* and the top center block 36*c*, respectively; its detailed description is omitted. In the embodiment, the top block 36 is formed of the top center block 36*c* and the top outside block 36*b*, and the bottom block 38 is formed of the center bottom block 38*c* and the outside bottom block 38*b*. Moreover, the bottom center block 38*c* is formed integrally with the exit pipe 32 and has at the center thereof an upper end portion 39*b* which is equivalent to the end portion of the exit pipe 32. The top center block 36*c* has at the center thereof an annular projecting portion 37*b* which forms the exit ring channel 42 together with the upper end portion 39*b* of the bottom center block 38*c*.

The same applies to the first embodiment shown in FIGS. 2 and 3. If desired, the downward extending portion of the exit pipe 32 may be followed by a portion that is bent in a desired direction.

Figure 7:
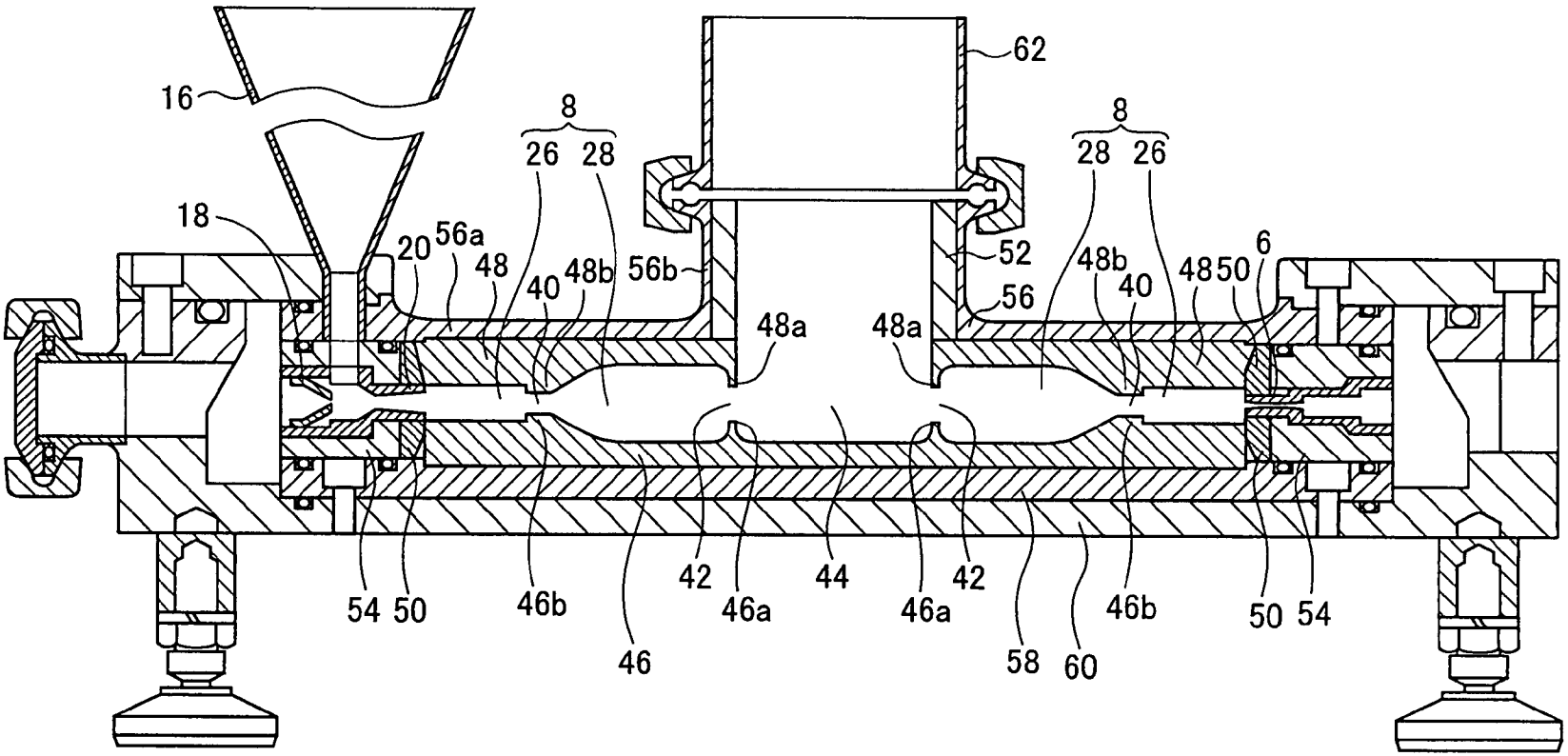
FIG. 7 is a side-sectional view showing in concept a jet mill according to yet another embodiment of the invention, having another improved specific configuration.

The jet mill according to a third embodiment of present invention shown in FIG. 7 is the one according to the first or second embodiment shown in FIG. 3 or 5 but with further modifications. In particular, the number of the components to form the grinding chamber and the exit space is further reduced to provide ease in fabrication of the jet mill, maintaining the performance equivalent to the ones in the first and second embodiments shown in FIGS. 1 to 3, 5 and 6.

The jet mill of the third embodiment shown in FIG. 7 comprises, as its main components, a grinding chamber 8 composed of a grinding zone 26 and a classifying zone 28, a classification ring channel 40 formed between the grinding zone 26 and the classifying zone 28, an exit space 44, a disk-shaped bottom plate 46 and a ceiling plate 48 forming together an exit ring channel 42 between the classifying zone 28 and the exit space 44, a grinding ring 50 forming an outside inner circumferential surface of the grinding zone 26, and an exit ring 52 connected with a circular opening at center of the disk-shaped ceiling plate 48 to form the exit space 44 together with the bottom plate and the top plate 48.

In the jet mill of the embodiment, the grinding zone 26 is formed of an annular hollow having a constant hollow width in the radius direction, and the classifying zone 28 is formed of a hollow whose width gradually increases from its outer side toward the center halfway and then becomes constant. And, the constant width of the hollow in the classifying zone 27 is wider than that of the grinding zone 26.

Further, also in this embodiment of the present invention, similarly to the jet mill shown in FIG. 5, the classification ring channel 40 and the exit ring channel 42 are together formed by the bottom plate 46 and the ceiling plate 48 as constricted passageways.

More specifically, the exit ring channel 42 is formed as a constricted passageway between an annular convex portion 48*a* of the ceiling plate 48, extruding toward the bottom plate 46 along an opening bored in center of the ceiling plate 48 and an annular convex portion 46*a* correspondingly provided on the bottom plate 46, by which the classifying zone 28 and the exit space 44 are divided from each other. On the other hand, the classification ring channel 40 is formed as a constricted passageway between an annular convex portion 46*b* outside the annular convex portion 46*a* of the bottom plate 46, extruding toward the ceiling plate 48 and an annular convex portion 48*b* correspondingly provided to the ceiling plate 48, by which the grinding zone 26 and the classifying zone 28 are divided from each other.

In this embodiment of the present invention, the bottom plate 46, the ceiling plate 48, the grinding ring 50, the exit ring 52, tips of the air nozzles 6 and the supply nozzle 18 are made of hard ceramics such as sialon, since they are intended to be hit or collided by the material to be ground carried by a high-speed air flow.

Thus, the jet mill of the embodiment further comprises an outer wall support ring 54 for supporting the grinding ring 50 from outside thereof, an upper support plate 56 for supporting the ceiling plate 48, the grinding ring 50, the outer wall support ring 54 and the exit ring 52 from upper side or outside thereof, a bottom support plate 58 for supporting the bottom plate 46, the grinding ring 50 and the outer wall support ring 54 from backside thereof, and a mill body base 60 for supporting the bottom support plate 58 from the backside thereof, on which the mill body is mounted.

Other than these, the outer wall support ring 54 of the jet mill in the this embodiment also comprises air nozzles 6, a funnel 16, and a feed inlet 14 with the supply nozzle 18 and the diffuser 20, similarly to the first and second embodiments as shown in FIGS. 1, 5 and others.

The upper support plate 56 consists of a doughnut-shaped plate portion 56*a* which supports the ceiling plate 48, the grinding ring 50 and the outer wall support ring 54 from upper side thereof, and a cylindrical portion 56*b* which supports the exit ring 52 from outside thereof.

The ceiling plate 48 and the doughnut-shaped plate portion 56*a* of the upper support plate 56 together form a top-plate assembly (refer to the top plate 10 shown in FIG. 2), and the bottom plate 46 and the bottom support plate 58, or the bottom plate 46, the bottom support plate 58 and the mill body base 60 form a bottom-plate assembly (refer to the bottom plate 12 shown in FIG. 2). In the meantime, the cylindrical portion 56*b* of the upper support plate 56 has its top part connected with the upper pipe 62; together with the exit ring 52, the cylindrical portion 56*b* and the upper pipe 62 form an exit-pipe assembly (refer to the exit pipe 32 shown in FIG. 5).

In the jet mill with such configuration, the bottom plate 46, the ceiling plate 48 or the exit ring 52 can be readily replaced; the classification ring channel 40 or the exit ring channel 42 can be made adjustable in its opening width; and the classification ring channel 40, the exit ring channel 42, the grinding zone 26 or the classifying zone 28 can be made adjustable in its size and position.

The foregoing embodiments and examples are shown for illustrative purposes only and are by no means intended to limit the present invention. Various modifications and improvements can of course be made without departing from the spirit and scope of the invention.

What is claimed is:

1. A jet mill comprising:

a jet mill body forming a disk-shaped hollow part and having an annular outer wall;

plural air nozzles generating high-speed air flow in said disk-shaped hollow part and being inclined on said annular outer wall with respect to a center of said disk-shaped hollow part; and an exit port being provided in a substantially central area of said disk-shaped hollow part of said jet mill body, wherein said hollow part comprises:

an annular grinding zone that is provided inside said annular outer wall and where a material to be ground is milled by means of said high-speed air flow supplied through said plural air nozzles;

an annular classifying zone that is provided inside said annular grinding zone and communicates with a space of said exit port and where said milled material is classified by means of air flow that is positioned inward of said annular grinding zone; and a first annular constricted passageway that is provided between said annular grinding zone and said annular classifying zone and that divides said hollow part into said annular grinding zone and said annular classifying zone, wherein said annular grinding zone and said annular classifying zone communicate by means of said first annular constricted passageway.

2. The jet mill according to claim 1, wherein said jet mill body further comprises:

an upper casing shaped substantially like a disk; and a lower casing shaped substantially like a disk, wherein said annular outer wall is disposed between said upper casing and said lower casing, and wherein said disk-shaped hollow part is an interior space formed between said upper casing and said lower casing, and inside said annular outer wall.

3. The jet mill according to claim 1, wherein said first annular constricted passageway is formed between a top surface and a bottom surface of said disk-shaped hollow part to give a predetermined spacing.

4. The jet mill according to claim 1, wherein said first annular constricted passageway is an annular channel formed between annular barriers that are mounted on a top surface and a bottom surface of said disk-shaped hollow part, respectively giving a predetermined spacing at a predetermined position in a radius direction of said hollow part.

5. The jet mill according to claim 1, wherein said annular grinding zone is an interior space where a distance between a top surface and a bottom surface of said disk-shaped hollow part is narrowed toward said center so that said top surface and said bottom surface of said hollow part approach asymptotically to each other toward said center, and wherein said first annular constricted passageway is an annular channel formed between first and second annular projecting portions of said top surface and said bottom surface of said disk-shaped hollow part that are mounted, respectively giving a predetermined spacing at a predetermined position in a radius direction of said hollow part.

6. The jet mill according to claim 1, further comprising:

a second annular constricted passageway that is provided between said classifying zone and said exit port provided inside said classifying zone and that divides said hollow part into said classifying zone and said space of said exit port, wherein said classifying zone and said space of said exit port communicate by means of said second annular constricted passageway.

7. The jet mill according to claim 6, wherein said second annular constricted passageway is formed between a top surface and a bottom surface of said disk-shaped hollow part, giving a predetermined spacing.

8. The jet mill according to claim 6, wherein said exit port is formed by means of an exit pipe provided in said substantially central area of said disk-shaped hollow part of said jet mill body so as to extend toward one of an upper side and a lower side of said jet mill body, and wherein said second annular constricted passageway is an annular channel formed between a first annular projecting portion at a lower end of said exit pipe extending toward said upper side and a disk or a second annular projecting portion in short tubular form that is provided on an upper side of said bottom surface of said hollow part, or said first annular projecting portion at an upper end of said exit pipe extending toward said lower side and said disk or said second annular projecting portion in short tubular form that is provided on a lower side of said top surface of said hollow part, and wherein said first annular projecting portion and said disk or said second annular projecting portion are provided, giving a predetermined spacing.

9. The jet mill according to claim 8, wherein said exit pipe is movable in a vertical direction with respect to said jet mill body, and wherein a width of said second annular constricted passageway is adjusted by moving said exit pipe in said vertical direction to move said first annular projecting portion toward or away from said disk or said second annular projecting portion.

10. The jet mill according to claim 6, wherein said exit port is formed by means of an exit pipe provided in said substantially central area of said disk-shaped hollow part of said jet mill body so as to extend toward an upper side or a lower side, and wherein said second annular constricted passageway is an annular channel formed between a first annular projecting portion at a lower end of said exit pipe extending toward said upper side and a second annular projecting portion that is provided on an upper side of said bottom surface of said hollow part, or said first annular projecting portion at an upper end of said exit pipe extending toward said lower side and said second annular projecting portion that is provided on a lower side of said top surface of said hollow part, and wherein said first annular projecting portion and said second annular projecting portion are provided to give a predetermined spacing.

11. The jet mill according to claim 10, wherein said exit pipe and one of an upper casing and a lower casing of said jet mill body are formed in an integral form, both of said upper casing and said lower casing being shaped substantially like a disk, and wherein said disk-shaped hollow part is an interior space formed between said upper casing and said lower casing, and inside said annular outer wall.

12. The jet mill according to claim 6, wherein said second annular constricted passageway is arranged substantially orthogonal to an axis of circular air flow in the disk-shaped hollow part.

13. The jet mill according to claim 1, wherein said disk-shaped hollow part of said jet mill body comprises a flat shape and further comprises a continuous disk-shaped hollow chamber.

14. The jet mill according to claim 1, wherein said first annular constricted passageway is substantially arranged orthogonal to an axis of circular air flow in said disk-shaped hollow part.

15. The jet mill according to claim 1, wherein said first annular constricted passageway comprises a flat portion.

16. A jet mill comprising:

a jet mill body that comprises a disk-shaped hollow part and an annular outer wall;

plural air nozzles that generate high-speed air flow in said disk-shaped hollow part and are inclined on said annular outer wall with respect to a center of said disk-shaped hollow part; and an exit port arranged in a substantially central area of said disk-shaped hollow part of said jet mill body, wherein said hollow part comprises:

an annular grinding zone arranged inside said annular outer wall and where a material to be ground is milled using high-speed air flow supplied through said plural air nozzles;

an annular classifying zone arranged inside said annular grinding zone that communicates with a space of said exit port and where said milled material is classified using airflow that is positioned inward of said annular grinding zone; and a first annular constricted passageway arranged between said annular grinding zone and said annular classifying zone and that divides said hollow part into said annular grinding zone and said annular classifying zone, wherein said annular grinding zone and said annular classifying zone communicate through said first annular constricted passageway.

17. The jet mill according to claim 16, wherein said jet mill body further comprises:

an upper casing shaped substantially like a disk; and a lower casing shaped substantially like a disk, wherein said annular outer wall is disposed between said upper casing and said lower casing, and wherein said disk-shaped hollow part is an interior space formed between said upper casing and said lower casing, and inside said annular outer wall.

18. The jet mill according to claim 16, wherein said first annular constricted passageway is formed between a top surface and a bottom surface of said disk-shaped hollow part to give a predetermined spacing.

19. The jet mill according to claim 16, wherein said first annular constricted passageway is an annular channel formed between annular barriers that are mounted on a top surface and a bottom surface of said disk-shaped hollow part, respectively giving a predetermined spacing at a predetermined position in a radius direction of said hollow part.

20. The jet mill according to claim 16, wherein said annular grinding zone is an interior space where a distance between a top surface and a bottom surface of said disk-shaped hollow part is narrowed toward said center so that said top surface and said bottom surface of said hollow part approach asymptotically to each other toward said center, and wherein said first annular constricted passageway is an annular channel formed between first and second annular projecting portions of said top surface and said bottom surface of said disk-shaped hollow part that are mounted, respectively giving a predetermined spacing at a predetermined position in a radius direction of said hollow part.

21. The jet mill according to claim 16, further comprising:

a second annular constricted passageway that is provided between said classifying zone and said exit port provided inside classifying zone and that divides said hollow part into said classifying zone and said space of said exit port, wherein said classifying zone and said space of said exit port communicate through said second annular constricted passageway.

22. The jet mill according to claim 21, wherein said second annular constricted passageway is formed between a top surface and a bottom surface of said disk-shaped hollow part giving a predetermined spacing.

* * * * *